US012779319B2

(12) United States Patent
Skradski et al.

(10) Patent No.: US 12,779,319 B2
(45) Date of Patent: Nov. 3, 2026

(54) TABLETOP GAME

(71) Applicant: FUN INVENTIONS INC., Hamilton (CA)

(72) Inventors: Nicholas Kale Skradski, Hamilton (CA); Ivan Skradski, Hamilton (CA)

(73) Assignee: Fun Inventions Inc., Hamilton (CA)

( * ) Notice: Subject to any disclaimer, the term of this patent is extended or adjusted under 35 U.S.C. 154(b) by 102 days.

(21) Appl. No.: 17/931,278

(22) Filed: Sep. 12, 2022

(65) Prior Publication Data

US 2024/0082694 A1 Mar. 14, 2024

(51) Int. Cl.
*A63F 7/06* (2006.01)
*A63F 7/30* (2006.01)

(52) U.S. Cl.
CPC .... *A63F 7/0616* (2013.01); *A63F 2007/3005* (2013.01)

(58) Field of Classification Search
CPC ..... A63F 7/0616; A63F 2007/3005; A63F 2007/2454; A63F 2007/301; A63F 7/0668; A63F 7/305; A63F 2007/3015; A63F 2007/3025
USPC ..... 273/129 K, 108, 108.1; D21/318
See application file for complete search history.

(56) References Cited

U.S. PATENT DOCUMENTS 1,504,605 A * 8/1924 Clausen ..... A63F 7/0668 273/108.5
2,211,197 A * 8/1940 Cahoon ..... A23G 3/563 294/5.5
2,824,739 A * 2/1958 Frank ..... A63F 7/0668 273/108.1
3,679,209 A * 7/1972 Wexstaff ..... A63B 59/00 273/129 R
3,680,864 A * 8/1972 Peterson ..... A63F 9/16 273/108
3,931,972 A * 1/1976 Fabian ..... A63F 7/386 273/110

(Continued)

OTHER PUBLICATIONS

Expanded explanation with original document of "Tabletop Sports Game", Document ID CA-2591145-A1, Inventor name Michel Tessier, pp. 1-34. (Year: 2008).*

(Continued)

*Primary Examiner* — Sebastiano Passaniti
(74) *Attorney, Agent, or Firm* — Birch, Stewart, Kolasch & Birch, LLP

(57) ABSTRACT

A game configured to be placed on a tabletop or suitable support surface wherein the game of the present invention is configured to mimic the sport of soccer. The present invention includes a base member wherein the base member is planar in manner, rectangular in shape having a first end and second end. The base member has an upper surface having a covering superposed thereto wherein the covering has indicia to mimic a soccer field. A wall member is circumferentially present around the base member wherein the wall member includes a first end member and second end member opposedly located on the base member. The base member includes a plurality of apertures having rod members journaled therein wherein rod members extend upward from the base member and are perpendicular thereto. A ball striking member and ball member are provided and utilized to attempt to score goals into the net members.

11 Claims, 3 Drawing Sheets

(56) References Cited

U.S. PATENT DOCUMENTS 4,148,484 A * 4/1979 Georgiev ..... A63F 7/0608 273/108.55
4,257,599 A * 3/1981 Cutri ..... A63F 7/0668 273/108.5
4,274,635 A * 6/1981 Pakogian ..... A63F 7/0608 273/108.5
4,382,600 A * 5/1983 Vieira ..... A63F 7/0668 273/129 K
D277,014 S * 1/1985 Vieira ..... D21/339
D288,941 S * 3/1987 Germond ..... D21/365
5,042,860 A * 8/1991 Bouton ..... A23G 3/50 426/104
5,074,556 A * 12/1991 Loeppky ..... A63F 7/0668 D21/339
5,092,595 A * 3/1992 Daravina ..... A63F 7/0668 273/118 A
5,372,364 A * 12/1994 Arroyo ..... A63F 7/0668 273/108.5
5,417,421 A * 5/1995 Bagley ..... A63F 7/0668 273/126 R
5,423,537 A * 6/1995 Santana ..... A63F 7/0668 273/129 R
5,433,443 A * 7/1995 Ples ..... A63F 7/0684 273/108.56
5,735,749 A * 4/1998 Charbel ..... A63D 15/00 473/412
5,882,007 A * 3/1999 Gay ..... A63F 7/0668 273/108.1
D425,136 S * 5/2000 Martin, Sr. ..... D21/318
D446,250 S * 8/2001 Quiroga ..... D21/318
6,764,074 B2 * 7/2004 Bangerter ..... A63F 7/06 273/108.1
6,780,117 B1 * 8/2004 Osborne ..... A63F 7/0668 473/10
7,147,225 B2 * 12/2006 Navarro ..... A63F 7/06 273/242
7,204,487 B1 * 4/2007 Pohl ..... A63F 7/06 273/108.1
7,219,891 B2 * 5/2007 Giegerich ..... A63F 7/3065 273/108
10,722,781 B1 * 7/2020 Braunschweig ..... A63F 7/0616
2014/0353910 A1 * 12/2014 Nwanna ..... A63F 7/06 273/148 R
2020/0222795 A1 * 7/2020 Witherill ..... A63F 7/0616

OTHER PUBLICATIONS

Translated text and original document for Document ID: CN-1810335-A; with an Inventor name of Qian, Guo-dong; and titled "kicking toy figure", pp. 1-16; published Aug. 2, 2006. (Year: 2006).*

* cited by examiner

TABLETOP GAME

FIELD OF THE INVENTION

The present invention relates generally to games and game apparatus, more specifically but not by way of limitation, a tabletop game configured to replicate an experience of a soccer game wherein the present invention provides key elements of a soccer experience such as but not limited to strategic shot decisions and shot variety.

BACKGROUND

As is known in the art, soccer is the most popular sport in the world. It is estimated that close to three hundred million people across the world participate in the playing of soccer. Soccer participation ranges from casual games amongst friends to professional soccer leagues to global competitions such as but not limited to the World Cup, in which nations compete. While many enjoy playing the actual game of soccer, there are many times when an individual cannot play or would like to be challenged with a game that replicates some of the elements of a soccer game. Tabletop games are well known in the art and can provide enjoyment for those that participate in them. Conventional tabletop games are convenient and can be deployed and stored without much difficulty. These games cover a broad variety of sports and interests which include sports such as but not limited to baseball, football and soccer.

While tabletop soccer games are known in the art, there are many deficiencies to what they provide. By way of example but not limitation, existing tabletop soccer games often have ineffective construction and are unable to replicate a soccer field experience. Additionally, existing games often have rules and methods of play that are too complex which ultimately interferes in a player's ability to play the game and enjoyment thereof. Furthermore, many of the existing tabletop games do not have a structure that suitably simulates some of the physical elements of the game.

It is intended within the scope of the present invention to provide a tabletop game that is configured to replicate a playing of a soccer game wherein the construction of the present invention and method of play provide a realistic soccer-like experience.

SUMMARY OF THE INVENTION

It is the object of the present invention to provide a table top game apparatus that is configured to replicate playing a game of soccer wherein the present invention includes a base member that is rectangular in shape having an upper surface and further being planar in manner.

Another object of the present invention is to provide a soccer game apparatus configured to be placed on a suitable horizontal support surface such as but not limited to a table wherein the base member of the present invention includes a covering.

A further object of the present invention is to provide a table top game apparatus that is configured to replicate playing a game of soccer wherein the base member has a plurality of apertures formed in the upper surface therein and wherein the apertures are arranged in a specific pattern.

Still another object of the present invention is to provide a soccer game apparatus configured to be placed on a suitable horizontal support surface such as but not limited to a table that further includes a plurality of rod members wherein the plurality of rod members are configured to be inserted into the plurality of apertures.

An additional object of the present invention is to provide a table top game apparatus that is configured to replicate playing a game of soccer wherein the base member has secured thereto a wall member wherein the wall member is circumferentially disposed around a perimeter edge of the base member and extends vertically upward therefrom.

Yet a further object of the present invention is to provide a soccer game apparatus configured to be placed on a suitable horizontal support surface such as but not limited to a table wherein the wall member includes opposing end wall members wherein the opposing end wall members have a void formed therein located proximate the midpoint of the end wall members.

Another object of the present invention is to provide a table top game apparatus that is configured to replicate playing a game of soccer wherein each of the opposing end wall members further include net members operably coupled to the void formed at the midpoint of each end wall member.

An alternate object of the present invention is to provide a soccer game apparatus configured to be placed on a suitable horizontal support surface such as but not limited to a table that further includes a score keeping element on the top edge of wall members of the present invention.

Still a further object of the present invention is to provide a table top game apparatus that is configured to replicate playing a game of soccer wherein the present invention further includes a ball striking member wherein the ball striking member is operable to be employed to strike a provided ball member.

An additional object of the present invention is to provide a soccer game apparatus configured to be placed on a suitable horizontal support surface such as but not limited to a table wherein the ball striking member includes a first end and a second end that are broader than the midpoint.

A further object of the present invention is to provide a table top game apparatus that is configured to replicate playing a game of soccer wherein the cover element superposed the upper surface of the base member is manufactured from a textile material.

An alternative object of the present invention is to provide a soccer game apparatus configured to be placed on a suitable horizontal support surface such as but not limited to a table wherein the cover member further includes indicia imprinted thereon that replicate soccer field markings.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
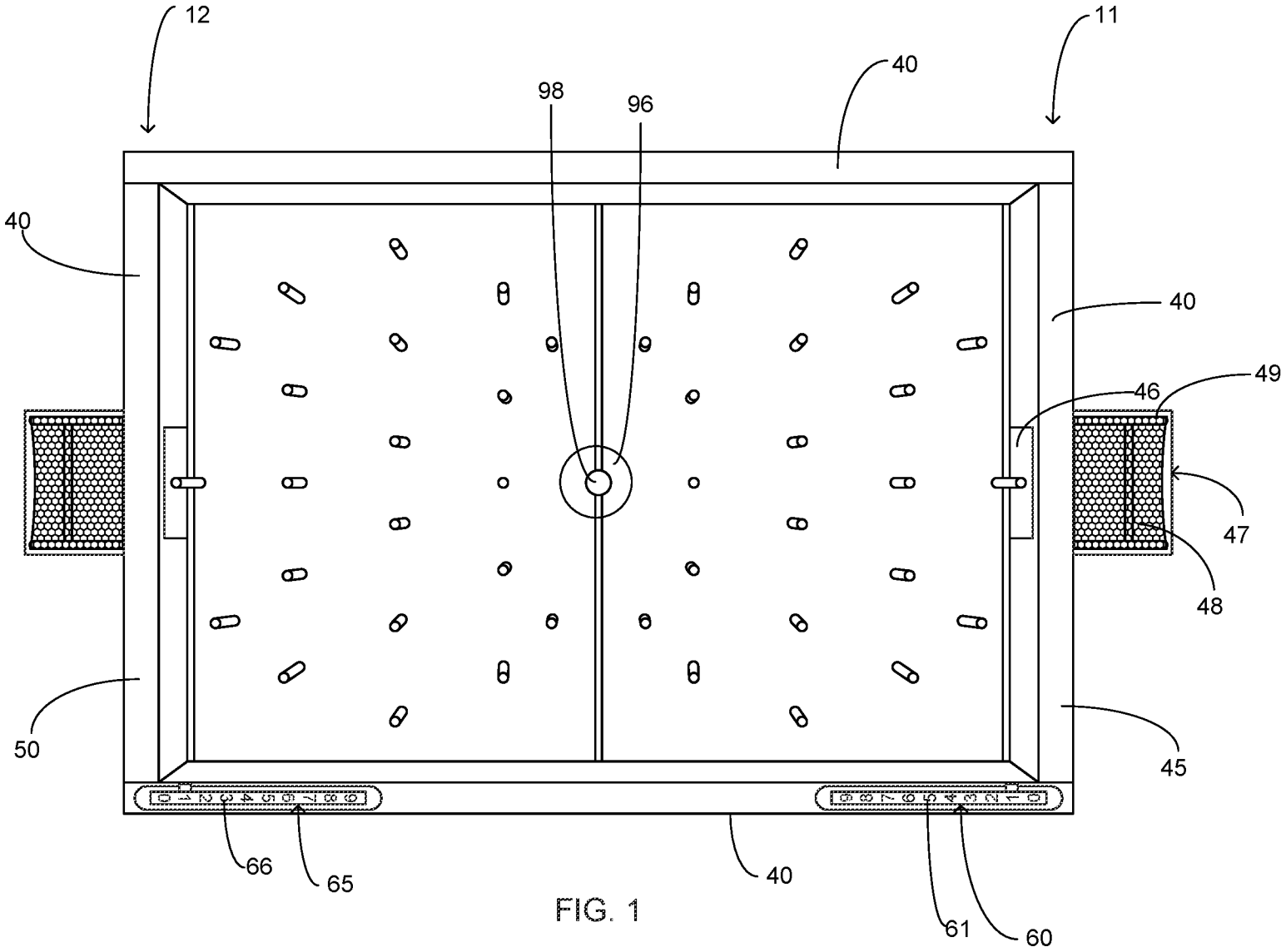
FIG. 1 is a top view of a preferred embodiment of the present invention.

Referring now to the drawings submitted herewith, wherein various elements depicted therein are not necessarily drawn to scale and wherein through the views and figures like elements are referenced with identical reference numerals, there is illustrated a tabletop game 100 constructed according to the principles of the present invention An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Figures submitted as a part hereof, the tabletop game 100 includes a base member 10. The base member 10 in a preferred embodiment is rectangular in shape having a first end 11 and a second end 12 and is manufactured from a lightweight rigid material such as but not limited to plastic or wood. The base member 10 includes an upper surface 14 wherein the upper surface 14 has a covering 15 superposed thereon. The covering 15 in a preferred embodiment is manufactured from a textile material so as to mimic turf on a soccer field. The covering 15 includes indicia 20 wherein the indicia 20 is utilized to replicate areas of a soccer field such as but not limited to the midpoint of the field or goalie zones. It should be understood within the scope of the present invention that the covering 15 could have various indicia 20 thereon marking alternate field zones, team names or marketing messages. It should be further understood within the scope of the present invention that the base member 10 could be provided in alternate sizes wherein it is preferred that the size of the base member 10 be such that the base member 10 is suitably sized to be placed on a horizontal support surface such as but not limited to a table top.

The base member 10 includes a plurality of apertures 25 wherein the plurality of apertures 25 are formed in the base member 10 utilizing suitable techniques. The apertures 25 are formed in rows which are in parallel with the first end 11 and the second end 12. The plurality of apertures 25 have journaled therein rod members 30. The rod members 30 are rod shaped and extend upward from the apertures 25 and are manufactured from a lightweight rigid material such as but not limited to metal, wood or plastic. The rod members 30 are manufactured of a suitable height in order to provide a sufficient obstacle for the ball member 70 during play of the tabletop game 100 as is further discussed herein. It should be understood within the scope of the present invention that the rod members 30 could be provided in alternate heights and are operable to represent players on a soccer field. It should be understood within the scope of the present invention that numerous alternate arrangement of rows of the rod members 30 could be employed. Additionally, it is contemplated within the scope of the present invention that the rod members 30 deployed on the base member 10 could alternate in height or all have the same height. While a specific pattern of apertures 25 and rod members 30 per half is illustrated herein, with the first row of apertures comprising a single aperture in front of void 46, the adjacent second row comprising more than one aperture (two, as shown), the next adjacent third row comprising more apertures than the second row (five, as shown), the next adjacent fourth row comprising more apertures than the third row (six, as shown), the next adjacent fifth row comprising the same number of apertures as the third row, and the final sixth row comprising the same number of apertures as the second row. However, it is contemplated within the scope of the present invention that the base member 10 could have as few as two apertures 25 and rod members 30 or a multitude of apertures 25 and rod members 30 arranged in alternate patterns. It should be understood within the scope of the present invention that the rod members 30 are releasably secured utilizing suitable techniques in the apertures 25.

The base member 10 further includes a wall member 40 operably coupled thereto and circumferentially present on the perimeter edge of the base member 10. The wall member 40 is manufactured from a lightweight and rigid material such as but not limited to wood or plastic. The wall member 40 is perpendicular to the base member 10 and extends upward therefrom and is configured to ensure the ball member 70 remains on the upper surface 14 of the base member 10 during play of the tabletop game 100. It should be understood within the scope of the present invention that the wall member 40 could be provided in alternate heights as well as be configured to be releasably secured to the base member 10 in order to facilitate storage of the tabletop game 100 when not in use. It is contemplated within the scope of the present invention that the wall member 40 could have indicia such as marketing indicia on the surface thereof.

Figure 2:
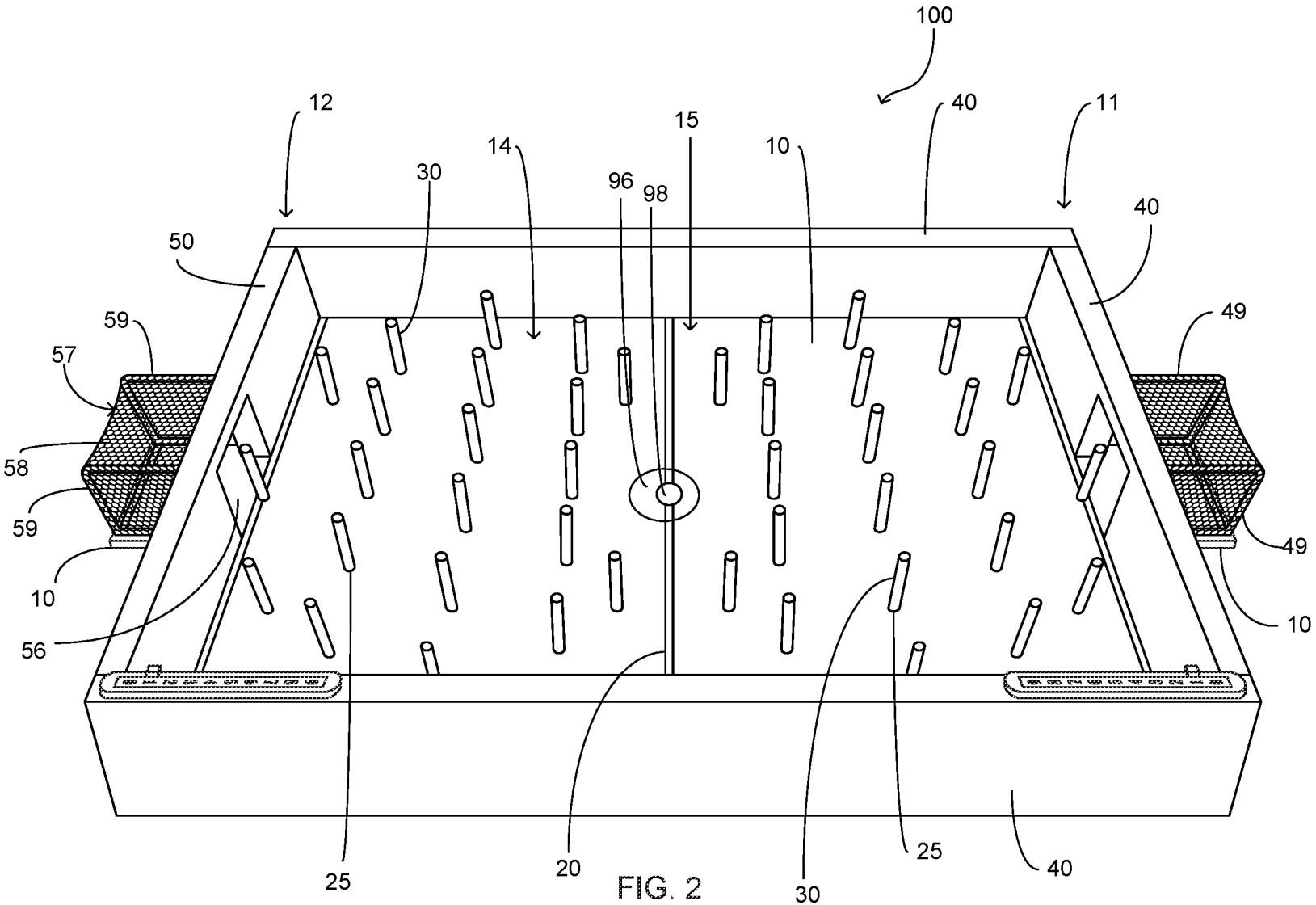
FIG. 2 is a top perspective view of the present invention.

The wall member 40 includes a first end wall member 45 proximate first end 11 and a second end wall member 50 proximate the second end 12. The first end wall member 45 includes void 46 having opposite side portions and a top portion, as shown in FIG. 2, wherein the void 46 is located approximately at the midpoint of the first end wall member 45. The first end wall member 45 surrounds the void 46 along each of the opposite side portions and along the top portion of the void 46. The void 46 has operably coupled thereto a first net member 47. The void 46 and first net member 47 combine to simulate a goal of a soccer field. The first net member 47 includes mesh material 48 and support members 49 operably coupled therewith so as to capture the ball member 70 ensuing the ball member 70 traversing through the void 46 formed in the first end wall member 45. It should be understood within the scope of the present invention that the support member 49 could be provided in alternate arrangements. Additionally, it should be understood within the scope of the present invention that the base member 10 could extend beyond the first end wall member 45 in order to provide support for the first net member 47 and a bottom therefore. As shown in FIG. 1, a first extension on the first end 11 of the base member 10 has a width less than a length of the first end wall member 45, with a length of the first end wall member 45 being in a direction perpendicular to a direction the first extension of the first end 11 extends from the first end 11. It is further contemplated within the scope of the present invention that the void 46 could be provided in alternate sizes. It is contemplated within the scope of the present invention that the additional sidewall members could extend beyond the first end wall member 45 and second end wall member 50 and have an additional wall member therebetween being parallel to the first end wall member 45 and second end wall member 50 forming a retention space configured to receive and retain a ball member therein. In this embodiment the base member 10 would extend to the additional wall members behind the first end wall member 45 and second end wall member 50.

The second end wall member 50 includes second void 56 having opposite side portions and a top portion, as shown in FIG. 2, wherein the second void 56 is located approximately at the midpoint of the second end wall member 50. The second end wall member 50 surrounds the second void 56 along each of the opposite side portions and along the top portion of the second void 56. The second void 56 has operably coupled thereto a second net member 57. The second void 56 and second net member 57 combine to simulate a goal of a soccer field. The second net member 57 includes mesh material 58 and support members 59 operably coupled therewith so as to capture the ball member 70 ensuing the ball member 70 traversing through the second void 56 formed in the second end wall member 50. As with the first net member 47, it is contemplated within the scope of the present invention that the second net member 57 could be provided with alternate arrangements of support member 59 and further have either a portion of the base member 10 or all of the base member 10 extend beyond the second end wall member 50. As shown in FIG. 1, a second extension on the second end 12 of the base member 10 has a width less than a length of the second end wall member 50, with a length of the second end wall member 50 being in a direction perpendicular to a direction the second extension of the second end 12 extends from the second end 12.

Additionally, it should be understood within the scope of the present invention that the second void 56 could be provided in alternate sizes.

The first end wall member 45 further includes first score keeping element 60 operably coupled thereto. The first score keeping element 60 includes numerical members 61 wherein the numerical members 61 are configured with indicia in order to facilitate the counting of points scored by a player of the tabletop game 100. In a preferred embodiment, the numerical members 61 are slidably traversed along the top edge of the first end wall member 45. However, it should be understood within the scope of the present invention that the first score keeping element 60 could be constructed in numerous alternate manners to include but not be limited to alternate mechanical or digital elements. The tabletop game 100 further includes a second score keeping element 65. The second score keeping element 65 includes numerical members 66 and is identically constructed as described herein to the first score keeping element 60. The second score keeping element 65 is configured to track a score for a second player of the tabletop game 100. While a first score keeping element 60 and second score keeping element 65 are disclosed herein, it is contemplated within the scope of the present invention that the tabletop game 100 could have only one score keeping element movably coupled to any portion of the wall member 40.

Figure 3:
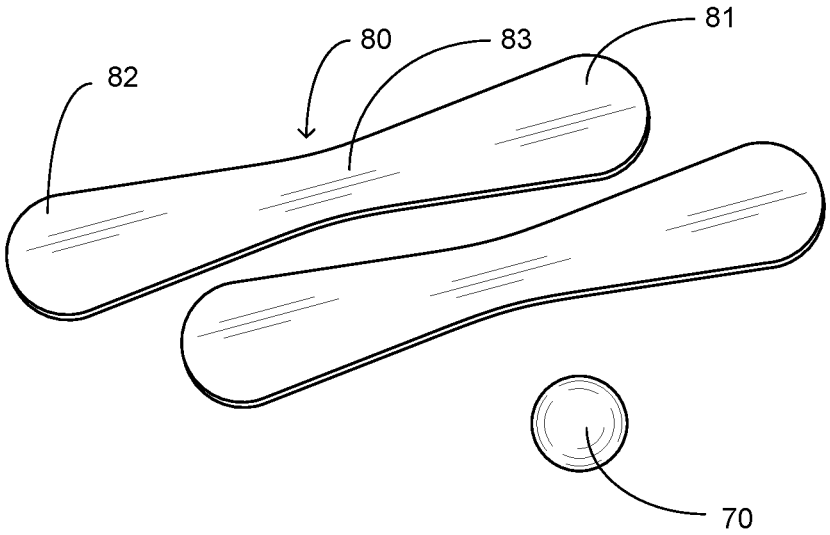
FIG. 3 is a detailed view of the ball striking members and ball member of the present invention.

Referring now to FIG. 3 submitted as a part hereof, the ball striking members 80 are illustrated therein. The ball striking members 80 are configured to facilitate striking of the ball member 70 by a user during play of the tabletop game 100. The ball striking member 80 includes a first end 81 and a second end 82 with a midpoint 83 therebetween. The ball striking member 80 is formed such that the width of the first end 81 and the second end 82 is greater than that of the midpoint 83. The preferred embodiment of the ball striking member 80 further has the first end 81 and second end 82 rounded in shape. It should be understood within the scope of the present invention that the ball striking member 80 could be formed in alternate shapes and sizes in order to achieve the desired objective discussed herein. It is additionally contemplated within the scope of the present invention that at least a portion of the ball striking member 80 could have a rubber coating superposed thereon to enhance player engagement therewith.

In use, the tabletop game 100, a player places the ball member 70 at the center mark 98 in the center circle 96. The player then strategically chooses the direction and type of shot he wants to take in navigating through the series of rod members 30 in an effort to score a goal by placing the ball member 70 into either the first net member 47 or second net member 57. Once decided, the executes a shot according by striking the ball member 70 with the ball striking member 80. If the player is unsuccessful in scoring a goal by propelling the ball member 70 into either the first net member 47 or second net member 57, then it becomes the other player's turn to take his shot from where the ball member 70 came to a stop from the previous shot. Each player alternates taking a shot after each turn in an effort to score a goal. Once a goal is scored, the ball member 70 is placed on the center mark 98 to resume play by the player who had conceded the goal. The match continues until a player reaches a predetermined number of goals and is declared the winner.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the claims.

What is claimed is:

1. A game apparatus wherein the game apparatus comprises:

a base member, said base member being planar, said base member having a first end and a second end, said base member having an upper surface;

a plurality of apertures, said apertures being formed in said upper surface of said base member on opposing halves thereof, said apertures arranged in six rows on each opposing half and the number of apertures being greater than eleven on each opposing half;

a plurality of rod members, each of said rod members being inserted into a corresponding one of said apertures, said rod members being perpendicular to said base member and extending upward from said apertures;

a wall member, said wall member being circumferentially present around a perimeter edge of said base member, said wall member being perpendicular to said base member and extending upward therefrom, wherein said wall member includes a first end wall member, said first end wall member being proximate said first end of said base member, said wall member further including a second end wall member, said second end wall member being proximate said second end of said base member, said first end wall member having a first void proximate a midpoint thereof, said first void having opposite side portions and a top portion, said first end wall member surrounding said first void along each of said opposite side portions and along said top portion of said first void, said second end wall member having a second void proximate a midpoint thereof, said second void having opposite side portions and a top portion, said second end wall member surrounding said second void along each of said opposite side portions and along said top portion of said second void; and at least one ball striking member, said at least one ball striking member configured to strike a ball member superposed on the upper surface of the base member, wherein a first row of said apertures closest to said first end wall member and adjacent to a second row of said apertures comprises a single aperture positioned in front of said first void;

the second row of said apertures adjacent to said first row of apertures and a third row of apertures comprises more than one aperture;

the third row of said apertures adjacent to said second row of apertures and a fourth row of apertures comprises a number of apertures greater than the number of apertures in the second row;

the fourth row of said apertures adjacent to said third row of apertures and a fifth row of apertures comprises a number of apertures greater than the number of apertures in the third row;

the fifth row of said apertures adjacent to said fourth row of apertures and a sixth row of apertures comprises a number of apertures equal to the third row of apertures;

the sixth row of said apertures adjacent to said fifth row of apertures and closest to said opposing half comprises a number of apertures equal to the second row of apertures;

the game apparatus further includes a first net member, said first net member being operably coupled to the first void of said first end wall member, said first net member having a first portion of said base member extending thereunder;

the game apparatus further includes a second net member, said second net member being operably coupled to said second void of said second end wall member, said second net member having a second portion of said base member extending thereunder;

the base member includes a rectangle, a first extension along said upper surface of said base member on the first end of the base member, and a second extension along said upper surface of said base member on the second end of the base member, the first extension on the first end extending beyond the first end wall member and being under the first net member, the second extension on the second end extending beyond the second end wall member and being under the second net member, the first extension on the first end having a width less than a length of the first end wall member and the second extension on the second end having a width less than a length of the second end wall member, the length of the first end wall member being in a direction perpendicular to a direction the first extension of the first end extends from the first end, the length of the second end wall member being in a direction perpendicular to a direction the second extension of the second end extends from the second end; and the second row of apertures and the sixth row of apertures each comprise two apertures, the third row of apertures and the fifth row of apertures each comprise five apertures and the fourth row of apertures comprises six apertures.

2. The game apparatus as recited in claim 1, and further including a covering, said covering being superposed on said upper surface of said base member, wherein the covering is manufactured from a textile material, said covering having indicia thereon wherein the indicia represents markings on a soccer field.

3. The game apparatus as recited in claim 1, wherein said at least one ball striking member includes a first end and a second end, said first end and said second end of said at least one ball striking member having a width greater than that of a midpoint of said at least one ball striking member.

4. The game apparatus as recited in claim 1, and further including at least one score keeping element, said at least one score keeping element being movably coupled to an upper edge of said wall member.

5. The game apparatus as recited in claim 1, wherein the first net member further includes a first mesh material supported by at least one first support member, the second net member further includes a second mesh material supported by at least one second support member, the first extension, the first net member and the at least one first support member being configured to capture a ball member traversing through the first void, and the second extension, the second net member and the at least one second support member being configured to capture the ball member traversing through the second void.

6. The game apparatus as recited in claim 1, and further including a ball member, said ball member operably to be engaged by said at least one ball striking member.

7. A game apparatus comprising:

a base member, said base member being planar, said base member having a first end and a second end, said base member having an upper surface, said upper surface having a covering, said covering being manufactured from a textile, said covering having indicia imprinted thereon, said indicia being similar to that of field of play markings on a soccer field;

a plurality of apertures, said plurality of apertures being formed in said upper surface of said base member on opposing halves thereof, said apertures arranged in six rows on each opposing half and the number of apertures being greater than eleven on each opposing half;

a plurality of rod members, said plurality of rod members being inserted into said plurality of apertures, said plurality of rod members being perpendicular to said base member and extending upward from said plurality of apertures;

a wall member, said wall member being circumferentially present around a perimeter edge of said base member, said wall member being perpendicular to said base member and extending upward therefrom, wherein said wall member includes a first end wall member, said first end wall member being proximate said first end of said base member, said wall member further including a second end wall member, said first end wall member having a first void proximate a midpoint thereof, said first void having opposite side portions and a top portion, said first end wall member surrounding said first void along each of said opposite side portions and along said top portion of said first void, said second end wall member having a second void proximate a midpoint thereof, said second void having opposite side portions and a top portion, said second end wall member surrounding said second void along each of said opposite side portions and along said top portion of said second void, said base member extending beyond said first end wall member and extending beyond said second end wall member; and at least one ball striking member, said at least one ball striking member configured to strike a ball member superposed on the upper surface of the base member, wherein a first row of said apertures closest to said first end wall member and adjacent to a second row of said apertures comprises a single aperture positioned in front of said first void;

the second row of said apertures adjacent to said first row of apertures and a third row of apertures comprises more than one aperture;

the third row of said apertures adjacent to said second row of apertures and a fourth row of apertures comprises a number of apertures greater than the number of apertures in the second row;

the fourth row of said apertures adjacent to said third row of apertures and a fifth row of apertures comprises a number of apertures greater than the number of apertures in the third row;

the fifth row of said apertures adjacent to said fourth row of apertures and a sixth row of apertures comprises a number of apertures equal to the third row of apertures;

the sixth row of said apertures adjacent to said fifth row of apertures and closest to said opposing half comprises a number of apertures equal to the second row of apertures;

the game apparatus further includes a first net member, said first net member being operably coupled to the first void of said first end wall member, said first net member having a first portion of said base member extending thereunder;

the game apparatus further includes a second net member, said second net member being operably coupled to the second void of said second end wall member, said second net member having a second portion of said base member extending thereunder;

the base member includes a rectangle, a first extension along said upper surface of said base member on the first end of the base member, and a second extension along said upper surface of said base member on the second end of the base member, the first extension on the first end extending beyond the first end wall member and being under the first net member, the second extension on the second end extending beyond the second end wall member and being under the second net member, the first extension on the first end having a width less than a length of the first end wall member and the second extension on the second end having a width less than a length of the second end wall member, the length of the first end wall member being in a direction perpendicular to a direction the first extension of the first end extends from the first end, the length of the second end wall member being in a direction perpendicular to a direction the second extension of the second end extends from the second end; and the second row of apertures and the sixth row of apertures each comprise two apertures, the third row of apertures and the fifth row of apertures each comprise five apertures, and the fourth row of apertures comprises six apertures.

8. The game apparatus as recited in claim 7, wherein said at least one ball striking member is planar having a first end and a second end that are rounded in shape, said at least one ball striking member having a width at said first end and said second end that are equivalent, said at least one ball striking member having a midpoint wherein the midpoint has a width that is less than that of said first end and said second end of said at least one ball striking member.

9. The game apparatus as recited in claim 7, and further including at least one score keeping element, said at least one score keeping element being movably coupled to an upper edge of said wall member.

10. The game apparatus as recited in claim 7, and further including a ball member, said ball member operably to be engaged by said at least one ball striking member.

11. The game apparatus as recited in claim 7, wherein said first net member further includes a first mesh material supported by at least one first support member, the second net member further includes a second mesh material supported by at least one second support member, the first extension, the first net member and the at least one first support member being configured to capture the ball member traversing through the first void, and the second extension, the second net member and the at least one second support member being configured to capture the ball member traversing through the second void.

* * * * *